US006283756B1

(12) United States Patent
Danckwerth et al.

(10) Patent No.: US 6,283,756 B1
(45) Date of Patent: Sep. 4, 2001

(54) MANEUVER TRAINING SYSTEM USING GLOBAL POSITIONING SATELLITES, RF TRANSCEIVER, AND LASER-BASED RANGEFINDER AND WARNING RECEIVER

(75) Inventors: Thomas M. Danckwerth, New Milford; Thomas A. Carmody, Burlington; William T. Krohn, Sandy Hook, all of CT (US)

(73) Assignee: The B.F. Goodrich Company, Charlotte, NC (US)

( * ) Notice: Subject to any disclaimer, the term of this patent is extended or adjusted under 35 U.S.C. 154(b) by 0 days.

(21) Appl. No.: 09/488,432

(22) Filed: Jan. 20, 2000

(51) Int. Cl.[7] ..... F41A 33/00
(52) U.S. Cl. ..... 434/11; 434/16
(58) Field of Search ..... 434/11, 14–17, 434/19, 21, 25, 27, 30, 35, 43, 62, 111, 379; 359/109, 159, 169, 170; 235/411–412, 414; 89/41.01, 41.06, 41.17, 41.19; 356/4.01, 141.1; 244/3, 14, 155 R, 90; 703/8; 701/2, 14, 213, 220, 301; 342/13, 169, 176; 324/73.1

(56) References Cited

U.S. PATENT DOCUMENTS

| | | | | |
|---|---|---|---|---|
| H613 | * | 4/1989 | Stello et al. | 434/19 |
| 4,227,261 | * | 10/1980 | Robertsson | 359/109 |
| 5,002,490 | * | 3/1991 | Blackstone | 434/14 |
| 5,228,854 | * | 7/1993 | Eldridge | 434/11 |
| 5,308,022 | * | 5/1994 | Cronkhite et al. | 244/3.14 |
| 5,378,155 | * | 1/1995 | Eldridge | 434/11 |
| 5,428,530 | * | 6/1995 | Brown et al. | 703/8 |
| 5,444,624 | * | 8/1995 | Wilkinson et al. | 703/8 |
| 5,556,281 | * | 9/1996 | FitzGerald et al. | 434/16 |
| 5,587,904 | * | 12/1996 | Ben-Yair et al. | 701/213 |
| 5,591,031 | * | 1/1997 | Monk et al. | 434/14 |
| 5,781,437 | * | 7/1998 | Wiemer et al. | 701/2 |
| 5,787,333 | * | 7/1998 | Rasinski et al. | 434/4 |
| 5,807,109 | * | 9/1998 | Tzidon et al. | 434/35 |
| 5,941,708 | * | 8/1999 | FitzGerald | 434/16 |

* cited by examiner

*Primary Examiner*—Joe H. Cheng
(74) *Attorney, Agent, or Firm*—Ohlandt, Greeley, Ruggiero & Perle LLP

(57) ABSTRACT

A combat maneuver training system includes a shooter platform (1) and a target platform (2). A first step is performed at the shooter platform, and operates a rangefinder (18) to determine a laser range of a shooter platform weapon (1A). At the target platform, the operation of the rangefinder is detected, and a controller (10) of the target platform transmits a current location (e.g. from GPS) of the target platform. At the shooter platform, when the target platform is in range, the controller (10) calculates an impact point of a simulated ordinance on the target platform and an impact time, and then transmits this and other information to the target platform. Meanwhile, an operator of the target platform, detecting the rangefinding operation, begins to maneuver the target platform to evade the simulated ordinance. At the calculated impact time the target platform transmits an updated current location of the target platform to the shooter platform and, based at least in part on the updated current location and on a type of shooter platform weapon, the status of the target platform (e.g. destroyed, disabled, fully operational) is determined. Each of the steps of transmitting may include a step of receiving the transmission at a control center, and then the method further includes a step of storing the received transmission in a memory of the control center for later recall and analysis, and/or operating a user interface of the control center for visualizing at least the locations of the shooter and target platforms, and the status of the shooter platform.

16 Claims, 3 Drawing Sheets

MANEUVER TRAINING SYSTEM USING GLOBAL POSITIONING SATELLITES, RF TRANSCEIVER, AND LASER-BASED RANGEFINDER AND WARNING RECEIVER

FIELD OF THE INVENTION

This invention relates generally to combat training systems and, more particularly, to combat training systems wherein a first mobile platform engages, targets and fires a simulated ordinance towards a second mobile platform, wherein the second mobile platform may maneuver to evade being hit by the simulated ordinance.

BACKGROUND OF THE INVENTION

Combat and maneuver training systems are used to provide valuable experience to military personnel, such as crews of armored vehicles. One system, known as the Multiple Integrated Laser Engagement System, or MILES and MILES 2000™ (Cubic Defense Systems, San Diego, Calif.), is a laser-based training system in which military personnel fire infrared "bullets" as adjuncts to the weapons and vehicles that they would use in actual combat. The simulated fire events cause realistic audio/visual effects and "casualties". The exercise events and casualties can be recorded, replayed and analyzed in detail during so-called After Action Reviews (AARs).

This particular type of combat and maneuver training system is susceptible to various types of manipulation. For example, the infrared sensors which detect the incoming infrared "bullets" can be fooled by painting the simulated battleground with light of the expected wavelength, thereby negating the precision accounted for in the digital date. Also by example, by simply obscuring the field of view of the sensor an incoming "hit" may not be recorded as such. It can be appreciated that over-zealous trainees, seeking to score well during a simulated combat exercise, may be able to significantly skew the results in their favor, while at the same time also lessening the value of the training exercise. In general, the detection of such manipulations can be difficult to accomplish.

It can be further appreciated that this type of training system requires the use of additional hardware (e.g., additional lasers, detectors and support hardware), thus incurring increases in cost, complexity and deployment logistics. For those cases where the training hardware follows the unit into the field, the additional hardware must be securely packed, shipped and accounted for. Before use, the additional lasers, detectors and the like must also be installed on the vehicles that will take part in the training exercise (e.g., tanks and other armored vehicles).

Furthermore, by using laser diodes to simulate weapons flyout, the inherent beam dispersion or beam divergence may not be consistent with the actual dispersion of the round being simulated. For example, the beam divergence for the training system laser diode may actually be several times the typical Circular Error Probability (CEP) of a particular "smart" weapon whose fire is being simulated.

OBJECTS AND ADVANTAGES OF THE INVENTION

It is a first object and advantage of this invention to provide an improved combat maneuver training system that overcomes the foregoing and other problems.

It is a second object and advantage of this invention to provide an improved combat maneuver training system wherein a first platform, the "shooter", transmits information to a second, mobile "target" platform, the information including the position of the first platform, weapon flyout and other data, thereby enabling the second platform to calculate whether it has maneuvered in such a way as to evade an incoming simulated round.

It is a further object and advantage of this invention to provide an improved combat maneuver training system wherein the mobile target platform transmits its position to the shooter after detecting that it has been illuminated by the shooter's laser rangefinder, enabling the shooter to calculate an impact point for its simulated ordinance.

It is another object and advantage of this invention to provide an improved combat maneuver training system wherein two platforms that are engaged in a simulated shooter/target relationship transmit GPS-derived position and other information between themselves in order to determine whether the target platform has successfully maneuvered to evade a simulated ordinance fired by the shooter, wherein the transmitted information can be monitored by a control center, stored, and subsequently used to replay the engagement.

SUMMARY OF THE INVENTION

The foregoing and other problems are overcome and the objects of the invention are realized by methods and apparatus in accordance with embodiments of this invention.

A method is disclosed for operating a combat maneuver training system of a type that includes a shooter platform and a target platform that are constructed and operated in accordance with embodiments of this invention. A first step of the method is performed at the shooter platform, and operates, preferably, an existing tactical laser such as a rangefinder, to determine if the target platform is within range of a shooter platform weapon. At the target platform, the operation of the rangefinder is detected, and a controller of the target platform transmits a current location of the target platform to the shooter platform. The current location is preferably obtained from a global positioning system (GPS) receiver. At the shooter platform, and for a case where the target platform is found to be in range, a controller calculates at least an impact point of a simulated ordinance on the target platform and an impact time, and then transmits at least this information to the target platform. Meanwhile, an operator of the target platform, having detected that the target platform was the subject of a rangefinding operation, assumes that the target platform is about to be fired on, and begins to maneuver the target platform to evade the simulated ordinance. At a time corresponding to the calculated impact time the target platform transmits an updated current location of the target platform to the shooter platform and, based at least in part on the updated current location and on a type of shooter platform weapon, the status of the target platform (e.g. destroyed, disabled, fully operational) is determined.

Each of the steps of transmitting may include a step of receiving the transmission at a control center, and then the method further includes a step of storing the received transmission in a memory of the control center for later recall and analysis, and/or operating a user interface of the control center for visualizing at least the locations of the shooter and target platforms, and the status of the shooter platform.

All of the various systems and subsystems used to provide the foregoing functionality may be found already installed within certain armored vehicles and other types of mobile platforms, thereby eliminating the need to provide, maintain and store additional hardware (e.g., additional lasers, detectors and support hardware) for use only during training. These already existing systems and subsystems are, however, used in a novel and non-obvious way in order to provide an improved maneuver training system.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1:
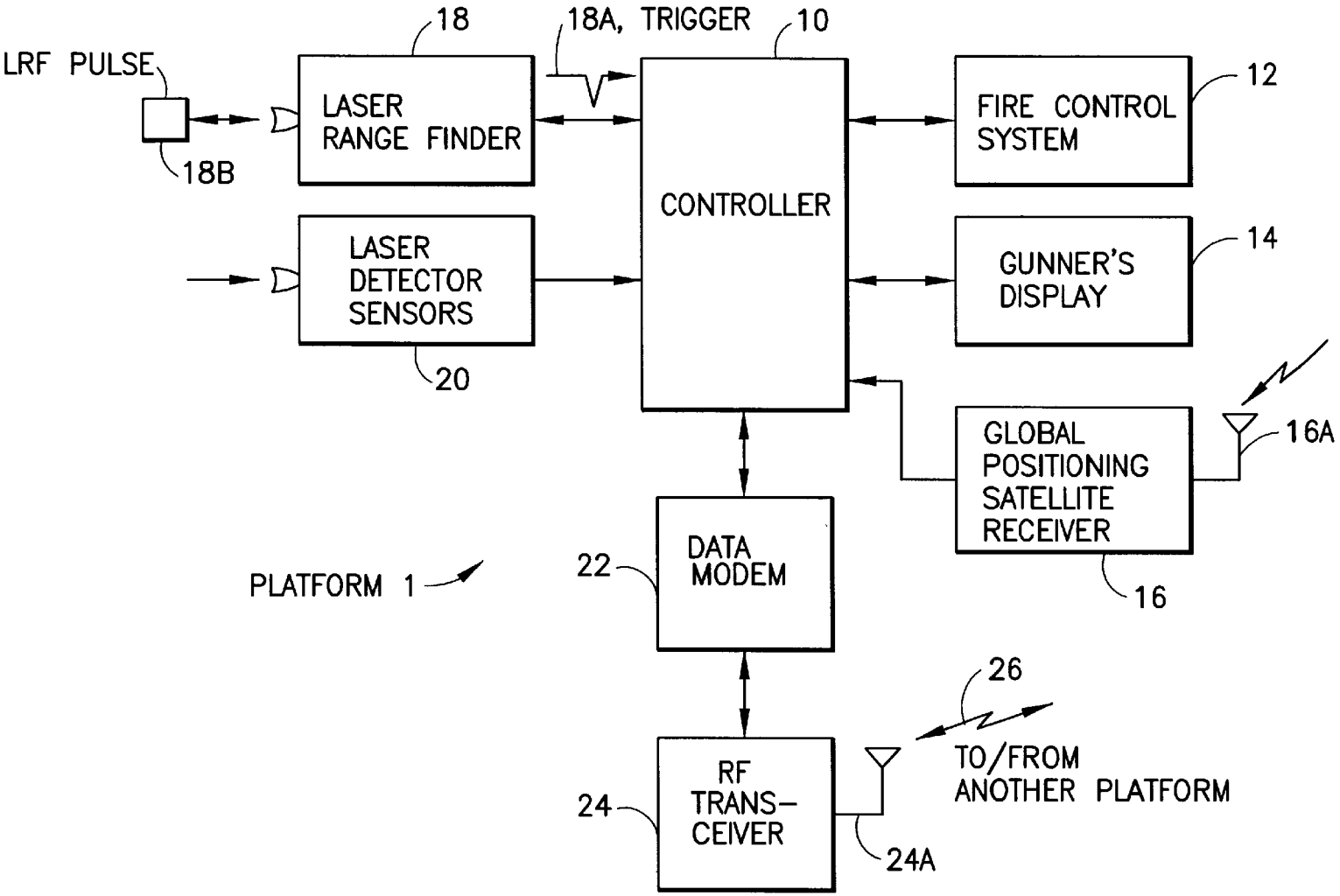
FIG. 1 is block diagram of a portion of a mobile platform that is constructed and operated in accordance with this invention.
Figure 2:
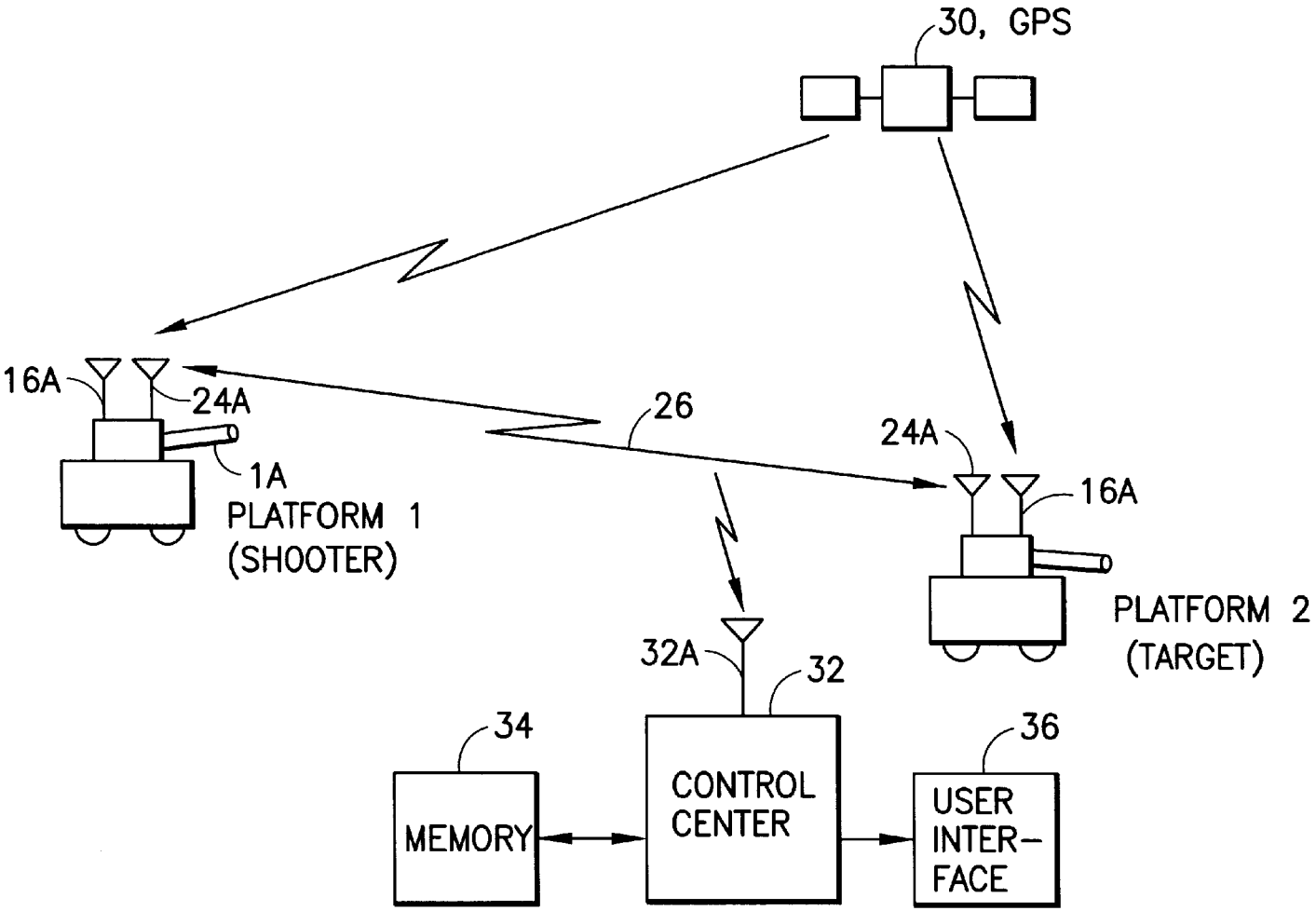
FIG. 2 is a simplified depiction of two mobile platforms, of a type depicted in FIG. 1, that are engaged in a simulated shooter/target relationship, and further depicting a control center capable of monitoring, storing and analyzing wireless transmissions between the two mobile platforms.

A simplified block diagram of a platform 1 is shown in FIG. 1. The platform 1 is typically a mobile platform that includes a weapons system, and may be, by example, a tank or some other combat vehicle. Those portions of the platform 1 that are most germane to the teachings of this invention include a controller 10, such as a suitably programmed microprocessor, having a plurality of input/output (I/O) lines connected to other systems and subsystems of the platform 1. These other systems and subsystems include a weapons fire control system 12, a gunner's display 14, a GPS receiver 16 having an antenna 16A, a laser rangefinder (LRF) 18 that fires a pulse of laser radiation to determine the range to a target (such as a second platform (Platform 2), as shown in FIG. 2), and a laser detector sensors or laser warning receiver unit 20 for detecting when the platform 1 has been interrogated by another laser rangefinder. Also coupled to the controller 10 is a data modem 22 that is bidirectionally coupled to a wireless (preferably RF) transceiver 24 having an antenna 24A (preferably an omnidirectional antenna). Through the antenna 24 the platform 1 is capable of making a bidirectional communication link 26 with another platform, as will be described in detail below. The controller 10 may include or have access to a real-time clock. It should be noted that other types of laser systems could be substituted or used to augment the LRF 28, such as a laser designator system or a guidance laser.

It should further be noted that all of the various systems and subsystems depicted in FIG. 1 may be found already installed within certain combat vehicles and other types of mobile platforms. However, the teachings of this invention use these various systems and subsystems in a novel and non-obvious manner in order to provide the improved combat maneuver training system that was mentioned previously, and the controller 10 is thus programmed appropriately to coordinate the operations of these various systems and subsystems. As such, the teachings of this invention avoid the problem relating to the additional cost and complexity incurred by the required additional hardware (e.g., additional lasers, detectors and support hardware) of the prior art. It should be further noted, however, that while the wireless (RF) transceiver 24 may be one already installed on the platform 1 for communication or other purposes, in some applications it may be more desirable to provide a separate wireless transceiver that is dedicated for use by the maneuver training system.

FIG. 2 illustrates the platform 1 (referred to hereafter also the "shooter") of FIG. 1 and a second platform 2 (the "target"), also constructed in the manner shown in FIG. 1, engaged in an exemplary simulated shooter/target relationship. At least the platform 1 is assumed to have a weapons system 1A, such as a cannon or a missile launcher. The weapons system 1A is assumed to be operated by the fire control system 12 shown in FIG. 1, and may be conventional in construction.

In a typical mode of operation, a gunner of the platform 1 acquires platform 2, such as by placing an image of platform 2 between cross-hairs using the gunner's display 14, and triggers the LRF 18 to determine the range to platform 2. Assuming that the acquired range is a valid range for the type of weapon system 1A, the fire control system 12 may then start an automatic sequence of events that leads to the firing of a round, or a missile, or some other type of ordinance at the platform 2. A few seconds may elapse between the time that a valid range is detected from the LRF 18 and the time that the weapon is discharged. Of course, in the simulated combat training system of interest to this invention the weapon is not actually discharged, and in the prior art system referred to above a laser is fired instead to simulate the firing of the weapon. However, this conventional approach suffers from the problems that were also discussed above.

When the pulse of laser light from the LRF 18 impinges on the platform 2, it is detected by the laser sensor detectors subsystem 20, which sends a signal to the controller 10. The receipt of this signal is an indication that the platform 2 has or is being targeted, and that evasive action should be taken in order to avoid the incoming ordinance (which could be expected within some number of seconds, depending on what type of weapons system 1A is carried by the platform 1.) It is an important aspect of this invention to provide improved evasive maneuver training to the crew of platform 2.

Also shown in FIG. 2 is a GPS satellite 30, which transmits signals received by the antennas 16A of both platforms 1 and 2. The received signals are conveyed to the GPS receiver 16, wherein an accurate position location of each platform is determined using suitable conventional techniques. Also derived from the received GPS signal is an accurate time indication, which can be used for setting and resetting the real time clock (if available), as well as altitude above sea level. The GPS signal is thus suitable for fixing the location of the receiving platform in three dimensional space to within some degree of accuracy, preferably within a volume of space that is smaller that the volume of the platform, and is also suitable for providing an accurate indication of the current time.

Also shown in FIG. 2 is an optional control center 32 having a receive antenna 32A for receiving the link 26 that is transmitted between the platforms 1 and 2. The received signals can be stored in a memory 24, processed, and then displayed on a user's interface 36. In this manner the control center 32 is enabled to provide a real-time or near real-time display of the simulated shooter/target relationship between platforms 1 and 2, as well as to replay the scenario at any desired later time.

Figure 3:
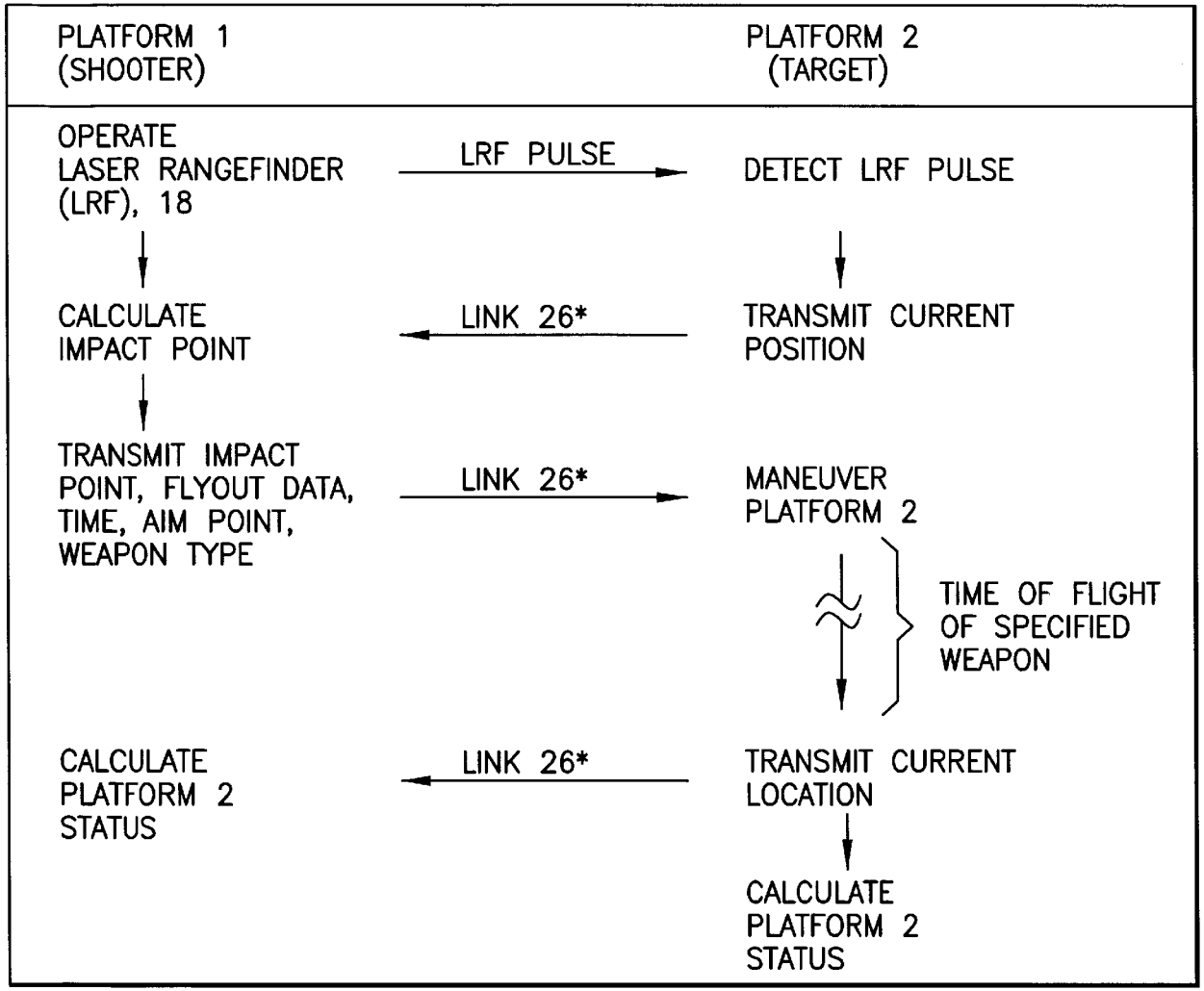
FIG. 3 is a logic flow diagram that is useful in explaining the operation of the platforms shown in FIG. 2, and also in gaining an understanding of a method in accordance with this invention.

Reference is now made to FIG. 3 for a description of the presently preferred embodiment of a method for operating the platforms 1 and 2 of FIG. 2.

When the gunner of platform 1 (the shooter) wishes to engage platform 2 (the target), the gunner fires at least one laser pulse 18B from the LRF 18. A trigger signal 18A (shown in FIG. 2) is then sent to the controller 10. At this time the fire control system 12 is assumed to begin final targeting of the platform 2 and to initiate the firing sequence for the weapons system 1A.

The laser detector sensors 20 of the target platform 2 detect the laser pulse 18B from the LRF 18 of platform 1 and, in accordance with an aspect of this invention, the controller 10 of platform 2 uses the data modem 22 to transmit at least the current GPS-derived position (latitude, longitude, altitude) of platform 2 over the link 26. The current time may be transmitted as well. It is noted that the receipt of the laser pulse 18B from platform 1 is a triggering input for causing the controller 10 of platform 2 to transmit its positional information.

The positional information from platform 2 is received by the antenna 24A of platform 1 and is passed through the RF receiver portion of the transceiver 14 to the data modem 22 and then to the controller 10. The received information is thus assumed to originate from whatever platform was just illuminated by the LRF 18 of platform 1 (although it is within the scope of this invention to embed platform identification information in the transmission as well). The controller 10 uses the received positional information to calculate, based on the weapon aimpoint received from the fire control system 12, the weapon type, etc., an expected impact point and impact time on the platform 2 of the simulated round about to be fired. Platform 1 then transmits to platform 2, through the data modem 22, the transmitter portion of the transceiver 24, the antenna 24A and the link 26, at least the following information:

a) Zulu Local Time;

b) the current, GPS-derived position of the platform 1;

c) the weapon aimpoint and predicted time of impact;

d) weapon flyout data (e.g., barrel elevation, missle velocity, attack angle); and e) weapon type.

The foregoing calculations and transmissions over the link 26 occur without the intervention of the occupants of either vehicle and, in fact, the occupants are preferably not aware of these underlying activities. What the gunner of platform 1 is aware of is that platform 2 was acquired and targeted, and that a simulated round or missile was fired. An occupant of platform 2 is aware of the fact that a laser rangefinder pulse impinged on the platform 2, and that the platform 2 must now be maneuvered to avoid the expected incoming round or missile (what type of weapons system is installed on platform 1, and thus the time of flight, etc., may be totally unknown to the operator of platform 2.)

The operator of platform 2 then maneuvers the platform in an attempt to avoid the incoming simulated ordinance. The maneuvering period coincides with the time of flight of the ordinance. At the end of this period the platform 2 has either: (a) completely avoided the incoming ordinance, (b) positioned itself such that the actual impact point is now capable of disabling, but not destroying, the platform 2, (c) positioned itself such that the actual impact point on the platform does not significantly impair the mobility or the operational status of the platform 2, (d) or has not successfully evaded the incoming ordinance such that the target platform 2 is considered to be destroyed. It should be noted that the operator of the platform 2 may have also employed a complementary system that has confused a tracking system of the incoming round.

In any event, at the previously predicted time of impact the platform 2 transmits to the platform 1, over the link 26, its current GPS-determined location. Based on the actual position of the platform 2 at the predicted time of impact, the platform 1 determines the status of platform 2 (e.g., not hit by the ordinance, hit but not disabled, hit and disabled, or hit and destroyed), in order to provide feedback to the crew of platform 1. The controller 10 of platform 2, in a preferred embodiment of this invention, also performs the same or similar calculations for immediately informing the crew of platform 2 of their current status, and can also trigger various types of devices, such as smoke and sound generators, for indicating the status of the platform. The weapons type information is useful for this purpose, as depending on where the computed point of impact is on platform 2, and the type of weapon, it can be determined if the impact was sufficient to destroy the platform, or disable the platform, or whether the impact had no significant operational effect of the platform 2. As such, the crew of platform 2 receives direct and immediate feedback as to the success of their maneuvering to avoid the simulated incoming ordinance. Furthermore, the maneuver training is accomplished without using an additional laser to simulate the incoming ordinance, and can instead employ only hardware that is normally installed upon the platforms 1 and 2.

The various RF transmissions passing between the shooter and target platforms may be received as well by the antenna 32A of the control center 32. Using these transmissions the control center 32 is enabled to generate on the user interface 36, in substantially real time, a visualization of the simulated battleground with the exact locations of the various participating platforms, as well as their current status. This information can be stored in the memory 34 as well for use in reconstructing and "playing back" the various platform engagements for use in reviewing the performance of the platform crews.

It is within the scope of this invention for the platform 2 to continuously transmit its positional information (for example, at half second intervals) during the time that it is maneuvering to avoid the incoming ordinance, thereby further enhancing the usefulness of the data collected by the control center 32.

It is also within the scope of this invention to suitably modulate the data to be transmitted onto the transmission from the laser rangefinder 18, as opposed to using the RF transceiver 24, or to use a laser transceiver in place of the RF transceiver.

While described above in the context of mobile terrestrial vehicles, such as tanks, those skilled in the art should realize that these teachings can be applied as well to other types of equipment, including fixed wing aircraft, helicopters and surface ships. These teachings can also be applied, with some modification, to submersible vessels. For example, the laser rangefinder 18 and the laser detector sensors 20 may be replaced with appropriate acoustic ranging and detection devices. In some types of systems on-board inertial navigation equipment, if of sufficient accuracy, may be used with or instead of the GPS receiver 16 to provide the position information. Other types of position location systems can be used as well, so long as they provide sufficient accuracy to resolve whether the maneuvering platform has successfully avoided being destroyed by an incoming simulated ordinance.

It should also be realized that it is not necessary for both of the platforms in FIG. 2 to be mobile platforms. For example, platform 1 could be a fixed gun emplacement or missile battery, while platform 2 is a mobile vehicle expected to maneuver to avoid incoming simulated fire from the fixed platform 1. In this case the platform 1 may not require the GPS receiver 16, as the position of the platform 1 could be determined upon installation and then simply stored in a memory of the controller 10.

It should be further noted that certain of the calculation steps may actually be performed by a data processor of the fire control system 12, e.g., the calculation of the impact point on the target platform and/or the time of impact, and then provided to the controller 10 for transmission to the target platform 2.

Thus, while the invention has been particularly shown and described with respect to preferred embodiments thereof, it will be understood by those skilled in the art that changes in form and details may be made therein without departing from the scope and spirit of the invention.

What is claimed is:

1. A combat maneuver training system, comprising:

a first, shooter platform;

a second, mobile target platform;

each of said platforms comprising a location determination system and a wireless transceiver for exchanging between themselves, when engaged in a simulated shooter/target relationship, at least location information, time information and weapon-related information, in order to determine whether the target platform successfully maneuvers to evade a simulated ordinance fired by the shooter platform.

2. A system as in claim 1, wherein information transmitted by said wireless transceivers is also received by a control center that comprises a memory for storing the received information, and a data processor for analyzing the information.

3. A system as in claim 1, wherein information transmitted by said wireless transceivers is also received by a control center that comprises a data processor for analyzing the information, and a user interface for visualizing the information.

4. A system as in claim 1, wherein said location determining system is comprised of a Global Positioning System receiver.

5. A shooter platform for use during a combat maneuver training exercise, comprising:

a location determination system;

a wireless transceiver;

a weapon controlled by a fire control system; and a controller having inputs coupled to outputs of said location determination system and said fire control system, said controller computing an impact point and a time of impact on the target platform of a simulated ordinance fired from said weapon, and for transmitting said computed impact point and time of impact, along with at least a current location of and time at the shooter platform, to the target platform using said wireless transceiver.

6. A shooter platform as in claim 5, wherein said controller is further responsive to a current location of the target platform, received from said wireless transceiver at a time equal to or later than said computed time of impact, for determining an actual point of impact of said simulated ordinance.

7. A shooter platform as in claim 5, wherein said controller further transmits at least an indication of the type of weapon to the target platform.

8. A target platform for use during a combat maneuver training exercise, comprising:

a location determination system;

a laser radiation detector;

a wireless transceiver; and a controller having inputs coupled to outputs of said location determination system and said laser radiation detector, said controller being responsive to a reception of a laser signal from a shooter platform for transmitting at least a current location of the target platform to the shooter platform using said wireless transceiver.

9. A target platform as in claim 8, wherein said controller is further responsive to a current location of the target platform, at a time corresponding to a time of impact of a simulated ordinance fired from a weapon of the shooter platform, for determining an actual point of impact of said simulated ordinance, and for transmitting the current location of the target platform to the shooter platform using said wireless transceiver.

10. A target platform as in claim 9, wherein said controller is further responsive to an indication of a type of weapon that is received from the shooter platform for determining, in conjunction with the actual point of impact, a current status of the target platform.

11. A method for operating a combat maneuver training system of a type that includes a shooter platform and a target platform, comprising steps of:

at the shooter platform, transmitting energy towards the target platform;

at the target platform, detecting the transmitted energy;

transmitting a current location of the target platform to the shooter platform in response to detecting the transmitted energy;

at the shooter platform, calculating at least an impact point of a simulated ordinance on the target platform and an impact time;

transmitting information to the target platform, the transmitted information comprising the calculated impact point and impact time;

maneuvering the target platform at least until a time that corresponds to the calculated impact time;

transmitting an updated current location of the target platform to the shooter platform; and based at least in part on the updated current location and on a type of shooter platform weapon, determining a status of the target platform.

12. A method as in claim 11, wherein each of the steps of transmitting include a step of receiving the transmission at a control center, and further comprising a step of storing the received transmission in a memory of the control center for later recall and analysis.

13. A method as in claim 11, wherein each of the steps of transmitting include a step of receiving the transmission at a control center, and further comprising a step of operating a user interface of the control center for visualizing at least the locations of the shooter and target platforms, and the status of the shooter platform.

14. A method as in claim 11, wherein the steps of transmitting a current location and transmitting an updated current location each comprise a step of operating a global positioning system satellite receiver to obtain a latitude, a longitude, and an altitude of the target platform.

15. A method as in claim 11, wherein the step of transmitting energy transmits laser energy.

16. A method as in claim 11, wherein the step of transmitting energy includes a step of operating a laser rangefinder system.

* * * * *